US005496197A

United States Patent [19]

Grivet

[11] Patent Number: 5,496,197

[45] Date of Patent: Mar. 5, 1996

[54] BATTERY CONNECTOR ASSEMBLY

[76] Inventor: Michael J. Grivet, 6492 Bose La., San Jose, Calif. 95120

[21] Appl. No.: 265,315

[22] Filed: Jun. 24, 1994

[51] Int. Cl.[6] ..... H01R 4/28; H01R 13/52

[52] U.S. Cl. ..... 439/726; 439/388; 439/522

[58] Field of Search ..... 200/52 R, 51 R; 439/388, 726, 759, 271, 522, 502, 501, 504, 510, 626, 627, 725, 726, 754–756, 757, 758, 766, 771, 797; 307/10.7; 429/121

[56] References Cited

U.S. PATENT DOCUMENTS

| | | | |
|---|---|---|---|
| 1,615,106 | 1/1927 | Bethea | 200/51 R |
| 1,951,259 | 3/1934 | Ryalls | 439/726 |
| 2,168,250 | 8/1939 | Toiberg et al. | 439/522 |
| 2,357,567 | 9/1944 | Williams | 439/756 |
| 2,500,182 | 3/1950 | Huertas | 337/10 |
| 2,523,215 | 9/1950 | Irvine | 290/37 R |
| 2,906,988 | 9/1959 | Stocking | 439/522 |
| 2,925,579 | 2/1960 | Osborn | 439/388 |
| 3,152,854 | 10/1964 | Osborn | 439/388 X |
| 3,662,322 | 5/1972 | Morrison | 439/388 |
| 3,790,920 | 2/1974 | Wening | 439/522 |
| 3,867,007 | 2/1975 | Wening | 439/522 |
| 4,012,104 | 3/1977 | Wening | 439/522 |
| 4,033,664 | 7/1977 | Norman | 439/388 |
| 4,042,759 | 8/1977 | Cella | 429/121 |
| 4,306,126 | 12/1981 | Howard | 200/52 R |
| 4,390,232 | 1/1983 | Jamgotchian | 439/38 |
| 4,830,624 | 5/1989 | Rose et al. | 439/388 |
| 4,929,191 | 5/1990 | Dufresne | 439/429 |
| 5,034,620 | 7/1991 | Cameron | 307/10.7 |
| 5,066,905 | 11/1991 | Betton et al. | 324/133 |
| 5,399,818 | 3/1995 | Golbeck et al. | 200/52 R |

*Primary Examiner*—J. R. Scott

*Attorney, Agent, or Firm*—Nixon, Hargrave, Devans & Doyle

[57] ABSTRACT

A battery connector assembly in accordance with the present invention has a cable end, terminal end, and sleeve. The cable end has a first connector detachably connected to an end of a cable and also has a pin having an outer surface extending out from the cable end. The terminal end has a second connector detachably connected to a battery terminal and has a post with a threaded exterior and a tubular pocket having an inner surface. The sleeve is rotatably seated on the pin and has a threaded interior. The threaded interior of the sleeve is engaged with the threaded exterior of the post so that when the sleeve is fully engaged on the post substantially the entire outer surface of the pin is engaged with substantially the entire inner surface of the tubular pocket in the post.

17 Claims, 1 Drawing Sheet

BATTERY CONNECTOR ASSEMBLY

FIELD OF THE INVENTION

This invention relates to battery connectors for facilitating the electrical connection and disconnection of battery cables to battery terminals.

BACKGROUND OF THE INVENTION

Battery connectors continue to enjoy popularity with automobile owners. The connectors allow automobile owners to electrically disconnect their batteries when servicing or storing their automobiles. Additionally, the connectors allow the owners to electrically disconnect their batteries to hinder automobile theft.

Prior battery connectors have had a number of problems. Typically, automobile engines require high starting currents. Many prior battery connectors limited the flow of current from the battery to the engine making it more difficult for the driver to start the automobile. The flow of current is limited in these prior connectors because connector contact area used point or line contacts at the point of connection, which raised the resistance at the point of connection.

Prior battery connectors have also been responsible for igniting gases discharged from batteries. As is well known, when an electrical connection is broken a spark may result at the point of connection. Despite the danger that these sparks pose, many prior connectors have not been designed to contain these sparks to prevent explosions.

Prior battery connectors have also not been designed to withstand corrosion. In fact, many of these prior connectors are constructed from materials, such as zinc alloys, which are extremely reactive when exposed to sulfuric acid from batteries. The corrosion experienced on these prior connectors made them difficult to operate and affected both the quality of the electrical connection and their esthetic appearance. The corrosion may become so severe that the connection is broken.

SUMMARY OF THE INVENTION

A battery connector assembly in accordance with the present invention has a cable end, terminal end, and sleeve. The cable end has a first connector detachably connected to an end of a cable and also has a tapered pin having an outer surface extending out from the cable end. The terminal end has a second connector adapted to connect to a battery terminal and has a post with a threaded exterior and a tapered tubular pocket having an inner surface. The sleeve is rotatably seated on the pin and has a threaded interior. The threaded interior of the sleeve engaging with the threaded exterior of the post so that when the sleeve is fully engaged on the post substantially the entire outer surface of the tapered pin is engaged with substantially the entire inner surface of the tapered tubular pocket in the post.

The pin may have a first cylindrical portion connected to a first truncated conical portion. The tubular pocket in the post may have a second cylindrical portion connected to a second truncated conical portion which substantially matches the size and shape of the first cylindrical portion and the first truncated conical portion. The sleeve may have a plurality of circumferentially spaced elongated indents. The first connector may have a first detachable half-shell portion adapted to be secured against a matching second half-shell portion extending from the cable end. The cable end has an opening for receiving an end of a cable bored between the first and second half-shell portions. The first and second half shell portions may have a plurality of serrations extending into the opening in the cable end to grasp the end of the cable between said first and second half-shell portions. The second connector may have a first half-ring clamp section with a first pair of ends extending out from the terminal end and is detachably secured against a second pair of ends from a second half-ring clamp section. The first and second half-ring clamp sections defining an opening for receiving a battery terminal.

The battery connector assembly provides several advantages. The assembly provides full surface contact at the point of connection which does not raise the resistance at the point of connection above that of the cable connected to the switch and thus does not interfere with the potential flow of starting current from the battery to the engine's electrical system. Additionally, the assembly captures any sparks which may occur at the point of connection between the pin and the post to prevent any explosions. Further, the battery connector assembly is made from corrosion resistant materials to withstand exposure to corrosive battery acids and ensure long use. Even further, once the assembly is installed the connection in the assembly can be easily opened or closed by the operator by hand.

DETAILED DESCRIPTION OF THE INVENTION

Figure 1:
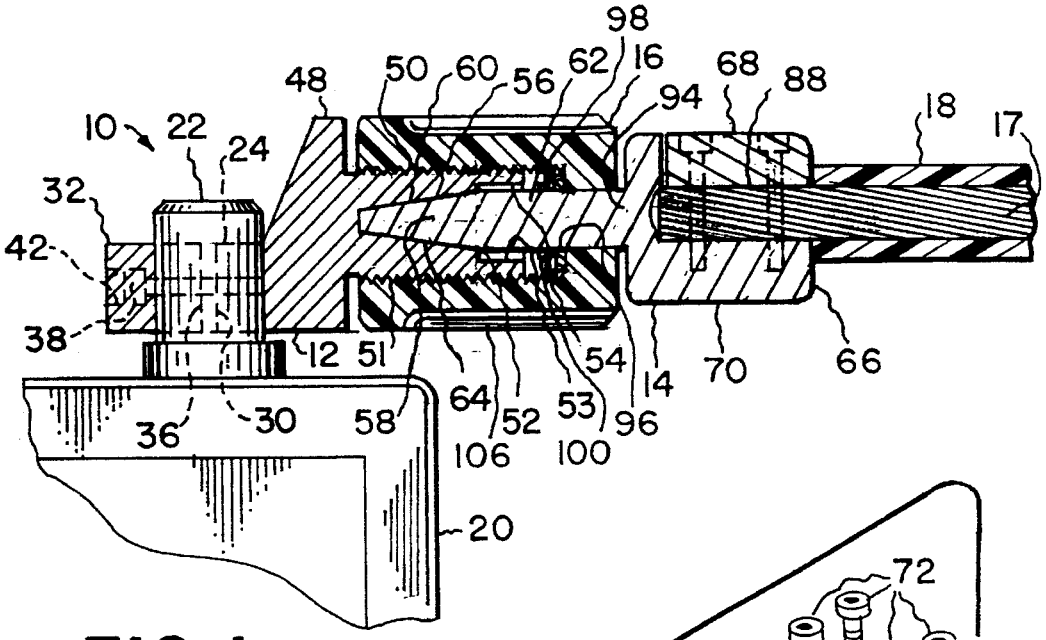
FIG. 1 is a cross-sectional view of a battery connector assembly, in accordance with the present invention, coupled between a positive battery terminal post and an end of a cable.
Figure 2:
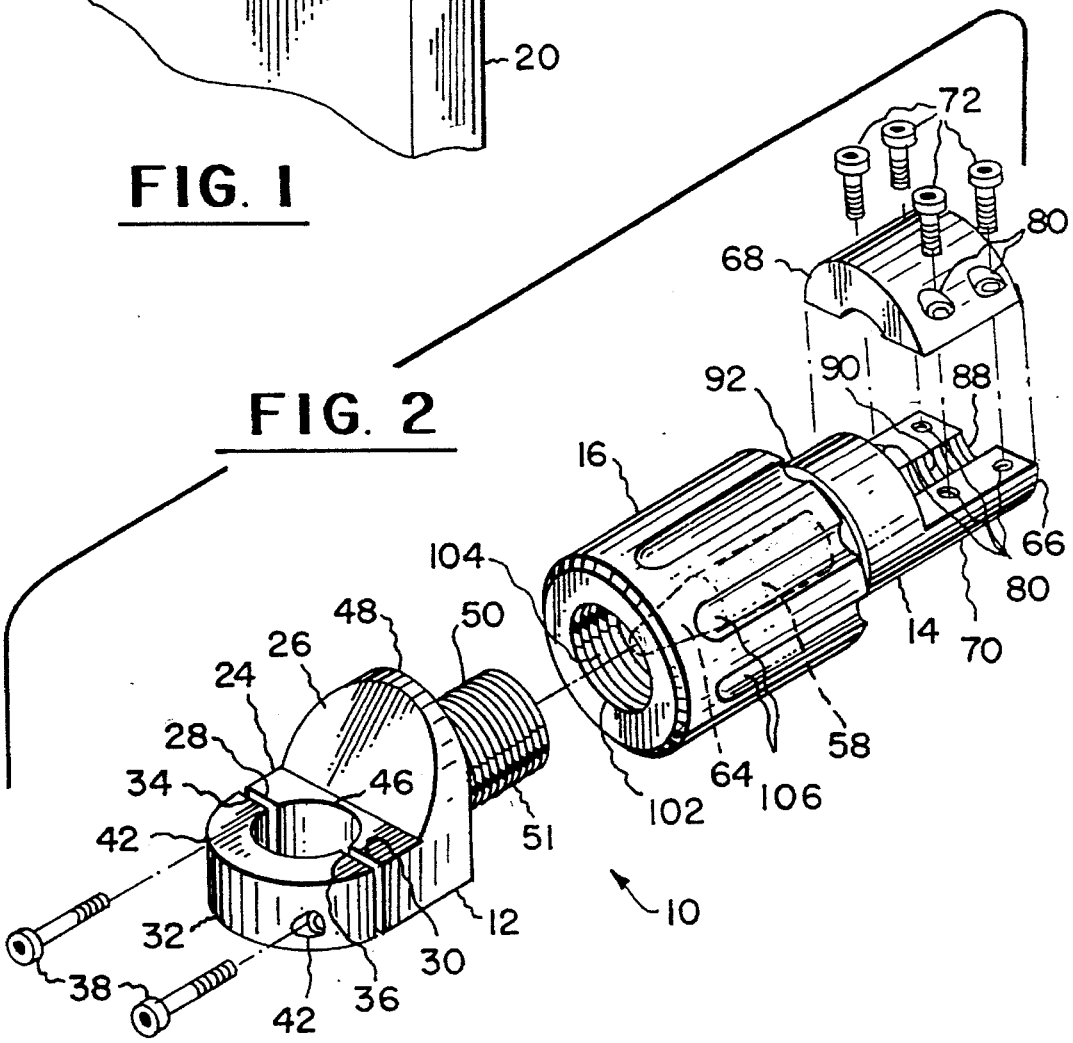
FIG. 2 is an exploded perspective view of the battery connector assembly shown in FIG. 1.

A battery connector assembly 10 in accordance with the present invention is illustrated in FIGS. 1 and 2. Assembly 10 includes a terminal end 12, a cable end 14, and a sleeve 16. Assembly 10 provides full surface contact at the point of connection which does not raise the resistance at the point of connection above that of a wire 17 in a cable 18 connected to assembly 10 and maintains the flow of current from battery 20 to the engine's electrical system (not shown). Assembly 10 also captures sparks when assembly 10 is opened or closed to prevent any explosions from occurring. Assembly 10 is made from corrosion resistant materials to withstand exposure to corrosive battery acids and ensure long use. Once installed, assembly 10 can be easily opened or closed by an operator without tools.

Referring to FIG. 1, a portion of battery 20 with a positive battery terminal 22 is shown. Battery connector assembly 10 can be connected by an operator to operate with either positive terminal 22 or a negative terminal post (not shown) on battery 20.

Referring to FIG. 2, terminal end 12 has a first half-ring clamp section 24 extending out from one side 26 of terminal end 12 and which terminates out at a pair of first ends 28 and 30. A matching second half-ring clamp section 32 with a second pair of ends 34 and 36 is detachably secured to first pair of ends 28 and 30 of first half-ring clamp section 24. A pair of screws 38 extend through openings 42 in first pair of ends 28 and 30 into second pair of ends 34 and 36 to secure first and second half-ring clamp sections 24 and 32 together. First and second half-ring clamp sections 24 and 32 define an opening 46 which fits around positive battery terminal 22 to make an electrical connection between positive battery terminal 22 and terminal end 12, as shown in FIG. 1.

The opposing side 48 of terminal end 12 from first half-ring clamp section 24 has a cylindrical post 50 which extends out from terminal end 12. Exterior of post 50 has threads 51 and interior of post 50 has a tubular pocket 52 with an inner surface 53. As shown in FIG. 1, tubular pocket 52 has a first elongated cylindrical portion 54 which extends into a second truncated conical portion 56. Terminal end 12 is constructed from corrosion resistant materials, such as a copper and chrome alloy which may be finished with gold plating.

Cable end 14 has a substantially cylindrical shape and includes a pin 58 with an outer surface 60 extending out from one side of cable end 14. Pin 58 has a second elongated cylindrical portion 62 which extends out to a second truncated conical portion 64. Pin 58 fits snugly within tubular pocket 52 in post 50 to provide full surface contact between outer surface 60 of pin 58 and inner surface 53 of tubular pocket 52 making an electrical connection. The full surface contact at the connection between pin 58 and post 50 does not increase the resistance at the point of connection above that in cable 18 connected to assembly 10 and does not restrict the flow of current from battery 20 to the engine's electrical system (not shown), like prior connectors.

The opposing side 66 of cylindrically shaped cable end 14 from pin 58 has a first detachable half-shell portion 68 cut out along the center diameter of opposing side 66 of cable end 14 and extending in along a portion of cable end 14. A second half-shell portion 70 remains attached to cable end 14 and extends out from opposing side 66 of cable end 14. Four screws 72 pass through four openings 80 in first and second half-shell portions 68 and 70 to secure portions together. An opening 88 is bored into the center of opposing side 66 of cable end 14 between first and second half-shell portions 68 and 70. Opening 88 extends along a portion of the center of cable end 14 and receives one end of battery cable 18. In this particular embodiment, first and second half-shell portions 68 and 70 include a plurality of serrations 90 which extend into opening 88 and enable cable end 14 to more securely grab wire 17 of cable 18 and make an electrical connection. Cable end 14 is also constructed from corrosion-resistant materials, such as a copper/chrome alloy which may be finished with gold plating.

The cylindrical sleeve 16 has a circular end 92 with an opening 94 which is rotatably seated on pin 58. A pair of spring washers 96 are seated on pin 58 near the interior surface of circular end 92 and with a retaining ring 98 seated between the washers 96 and a lip 100 on pin 58 to retain sleeve 16 on pin 58. Sleeve 16 extends out along the length of pin 58 and defines a cylindrical opening 102 around pin 58. The interior surface of sleeve 16 in opening 102 has threads 104 and is adapted to engage threads 51 on the exterior of post 50 from terminal end 12. Placing threads 104 onto threads 51 of post 50 and then turning sleeve 16 on post 50 draws pin 58 into tubular pocket 52 in post 50. When sleeve 16 is tightened down onto post 50, spring washers 96 seated around pin 58 assure clamping pressure of pin 58 in tubular pocket 52 in post 50 regardless of temperature changes. Sleeve 16 captures and contains sparks which may result when pin 58 is disconnected from tubular pocket 52 in post 50. Outer surface 60 of sleeve 16 has eight elongated indents 106 which extend along a portion of the length of sleeve 16 and can be grabbed by an operator to rotate sleeve 16 on pin 58 by hand. Although eight indents 106 are shown, greater or fewer indents 106 could be formed on sleeve 16, if desired. With sleeve 16, no tools are necessary to connect or disconnect power cables from an installed switch 10. Preferably, sleeve 16 is made from a nonconducting plastic material, such as black delrin.

To install battery connector assembly 10, one of battery cables 18 in the automobile is first disconnected from positive battery terminal 22. Next, two screws 38 which secure first and second pair of ends 28, 30, 34, and 36 for first and second half-ring clamp sections 24 and 32 are loosened or removed to enlarge opening 46 to fit around positive battery terminal 22. Opening 46 is placed over positive battery terminal 22 or first and second half-ring clamp sections 24 and 32 are placed around positive battery terminal 22, and then two screws 38 are reinserted, if removed, and tightened. Screws 38 secure first and second pair of ends 28, 30, 34, and 36 of first and second half-ring sections 24 and 32 together and against positive battery terminal 22 to make an electrical connection. Although one particular type of clamp to positive battery terminal 22 is shown other types of clamps are well known in the art and could be used to secure the battery terminal to terminal end 12.

Next, four screws 72 holding detachable first half-shell portion 68 against second half-shell portion 70 are loosened or removed to enlarge opening 88 in opposing side 66 of cylindrical shaped cable end 14. If wire 17 at the end of cable 18 is not exposed, then the end of cable 18 is stripped to expose wire 17. Wire 17 of cable 18 is placed in opening 88 or first and second half-shell portions 68 and 70 are placed around wire 17 of cable 18 and then four screws 72, if removed, are replaced and tightened. Screws 72 secure first and second half-shell portions 68 and 70 together and grasp wire 17 of cable 18 in cable end 14. As first and second half-shell portions 68 and 70 are tightened together, serrations 90 in the opening bite into the wire 17 to secure the connection in cable end 14. Once secured, an electrical connection between cable end 14 and wire 17 in cable 18 is established. Wire 17 in cable 18 could be coupled to cable end 14 before positive battery terminal 22 is coupled to terminal end 12.

Next, terminal end 12 is coupled to cable end 14 to complete the electrical connection. Threads 104 in opening 94 in sleeve 16 are engaged on threads 51 on exterior of post 50. Elongated indents 106 on sleeve 16 make it easy for the operator to rotate sleeve 16 connect and disconnect terminal and cable ends 12 and 14 from each other. Sleeve 16 contains any sparks which may result when the connection between post 50 and pin 58 is connected or disconnected and isolates them from explosive gases. As sleeve 16 is threaded onto post 50, pin 58 is drawn into tubular pocket 52 in post 50 sliding second truncated conical portion 64 and second elongated cylindrical portion 62 into substantially full surface contact with first truncated conical portion 56 and first elongated cylindrical portion 54 when fully engaged. When post 50 and pin 58 are close to making a connection or disconnection a spark may result. When sleeve 16 has been tightened down completely, then pin 58 is snugly fit within tubular pocket 52 of post 50 so that full surface contact between pin 58 and tubular pocket 52 in post 50 is obtained. The full surface contact between pin 58 and post 50 does not raise the resistance of the point of connection above that of cable 18 and does not reduce the flow of current from battery 20 to the engine's electrical system and thus not make it more difficult for a driver to start the automobile.

Having thus described the basic concept of the invention, it will be readily apparent to those skilled in the art that the foregoing detailed disclosure is intended to be presented by way of example only, and is not limiting. Various alterations, improvements, and modifications will occur and are intended to those skilled in the art, though not expressly stated herein. These modifications, alterations, and improvements are intended to be suggested hereby, and are within the spirit and scope of the invention. Accordingly, the invention is limited only by the following claims and equivalents thereto.

What is claimed is:

1. A battery connector assembly comprising:

a cable end having a first connector detachably connected to an end of a cable and having a pin having an outer surface extending out from said cable end;

a terminal end having a second connector detachably connected to a battery terminal and having a post with a threaded exterior and a tubular pocket having an inner surface; and a sleeve rotatably seated on said pin and having a threaded interior, the threaded interior of said sleeve engaging with the threaded exterior of the post so that when said sleeve is fully engaged on said post substantially the entire outer surface of said pin is engaged with substantially the entire inner surface of the tubular pocket in said post.

2. The connector assembly according to claim 1 wherein said pin has a first cylindrical portion connected to a first truncated conical portion and said tubular pocket has a second cylindrical portion connected to a second truncated conical portion which substantially matches the size and shape of said first cylindrical portion and said first truncated conical portion.

3. The connector assembly according to claim 1 wherein said sleeve has a plurality of circumferentially spaced elongated indents.

4. The connector assembly according to claim 3 wherein said sleeve is constructed from non-conducting plastic.

5. The connector assembly according to claim 1 wherein said cable end and said terminal end are constructed from corrosion-resistant materials.

6. The connector assembly according to claim 1 wherein said first connector comprises a first detachable half-shell portion detachably secured against a matching second half-shell portion extending from said cable end, said cable end having an opening for receiving an end of a cable bored between said first and second half-shell portions.

7. The connector assembly according to claim 6 wherein said first and second half-shell portions have a plurality of serrations extending into the opening in said cable end to grasp the end of the cable between said first and second half-shell portions.

8. The connector assembly according to claim 6 wherein said second connector comprises a first half-ring clamp section with a first pair of ends extending out from said terminal end and is detachably secured against a second pair of ends from a second half-ring clamp section, said first and second half-ring clamp sections defining an opening for receiving a battery terminal post.

9. A battery connector assembly comprising:

a cable end having a first connector detachably connected to an end of a cable and having a pin having an outer surface extending out from said cable end;

a terminal end having a second connector detachably connected to a battery terminal and having a post with a threaded exterior and a tubular pocket having an inner surface; and a sleeve having a plurality of circumferentially spaced elongated indents rotatably seated on said pin and having a threaded interior, the threaded interior of said sleeve engaging with the threaded exterior of the post so that when said sleeve is fully engaged on said post substantially the entire outer surface of said pin is engaged with substantially the entire inner surface of the tubular pocket in said post.

10. The connector assembly according to claim 9 wherein said cable end and said terminal end are constructed from corrosion-resistant materials.

11. The connector assembly according to claim 10 wherein said sleeve is constructed from non-conducting plastic.

12. The connector assembly according to claim 9 wherein said first connector comprises a first detachable half-shell portion detachably secured against a matching second half-shell portion extending from said cable end, said cable end having an opening for receiving an end of a cable bored between said first and second half-shell portions.

13. The connector assembly according to claim 12 wherein said second connector comprises a first half-ring clamp section with a first pair of ends extending out from said terminal end and is detachably secured against a second pair of ends from a second half-ring clamp section, said first and second half-ring clamp sections defining an opening for receiving a battery terminal post.

14. A battery connector assembly comprising:

a cable end having a first connector detachably connected to an end of a cable and having a pin having an outer surface extending out from said cable end, said first connector comprising a first detachable half-shell portion detachably secured against a matching second half-shell portion extending from said cable end, said cable end having an opening bored between said first and second half-shell portions to receive an end of a cable, said first and second half-shell portions have a plurality of serrations extending into the opening in said cable end to grasp the end of the cable;

a terminal end having a second connector detachably connected to a battery terminal and having a post with a threaded exterior and a tubular pocket having an inner surface; and a sleeve rotatably seated on said pin and having a threaded interior, the threaded interior or said sleeve engaging with the threaded exterior of the post so that when said sleeve is fully engaged on said post substantially the entire outer surface of said pin is engaged with the inner surface of the tubular pocket in said post.

15. The connector assembly according to claim 14 wherein said cable end and said terminal end are constructed from corrosion-resistant materials.

16. The connector assembly according to claim 15 wherein said sleeve is constructed from non-conducting plastic.

17. The connector assembly according to claim 14 wherein said second connector comprises a first half-ring clamp section with a first pair of ends extending out from said terminal end and is detachably secured against a second pair of ends from a second half-ring clamp section, said first and second half-ring clamp sections defining an opening for receiving a battery terminal post.

* * * * *